US005140843A

United States Patent [19]

Krueger

[11] Patent Number: 5,140,843

[45] Date of Patent: Aug. 25, 1992

[54] LOCK CONVERSION MECHANISM

[76] Inventor: Owen A. Krueger, 7016 E. Sunnyvale Rd., Paradise Valley, Ariz. 85253

[21] Appl. No.: 826,142

[22] Filed: Jan. 27, 1992

[51] Int. Cl.[5] ..... E05B 11/00

[52] U.S. Cl. ..... 70/429; 70/389

[58] Field of Search ..... 70/429, 428, 424, 416, 70/430, 441, 454, 408, 389

[56] References Cited

U.S. PATENT DOCUMENTS

| | | | |
|---|---|---|---|
| 921,390 | 5/1909 | Finn | 70/429 |
| 2,222,900 | 11/1940 | Fruns | 70/429 |
| 2,227,561 | 1/1941 | Taylor | 70/430 |
| 2,441,067 | 5/1948 | Helmes . | |
| 2,528,757 | 11/1950 | Kindler . | |
| 3,295,344 | 1/1967 | Hankins | 70/430 |
| 3,630,053 | 12/1971 | Krakauer . | |
| 3,927,544 | 12/1975 | Klein | 70/416 |
| 4,109,496 | 8/1978 | Alleman | 70/389 |
| 4,292,995 | 10/1981 | Mazzola | 70/408 |
| 4,583,383 | 4/1986 | Bosco | 70/408 |
| 5,003,803 | 4/1991 | Richards | 70/416 |
| 5,010,754 | 4/1991 | De Angelo | 70/389 |

FOREIGN PATENT DOCUMENTS

| | | | |
|---|---|---|---|
| 36012 | 5/1926 | Denmark | 70/429 |
| 3505959 | 8/1986 | Fed. Rep. of Germany | 70/424 |

*Primary Examiner*—Renee S. Luebke
*Assistant Examiner*—D. Boucher
*Attorney, Agent, or Firm*—LaValle D. Ptak

[57] ABSTRACT

A safety device is disclosed for converting the inside cylinder of a double cylinder deadbolt assembly to one which captivates a key inserted into the assembly to permit it to rotate to operate the deadbolt. The device prevents removal of the inside key under normal circumstances. This is accomplished by a base member, which is attached to the face of the inside cylinder or cylinder lock assembly. The base member has a circular opening in it, defined by an inwardly-turned shoulder. A key-holding member is rotatably captured between the shoulder of the base member and the face of the cylinder lock assembly, when it is secured to the face of the lock assembly, to permit insertion and rotation of a key in the lock assembly. The key-holding member includes a device for securing the key against removal from it when the assembly is in place. No modification of the cylinder lock assembly is necessary.

10 Claims, 2 Drawing Sheets

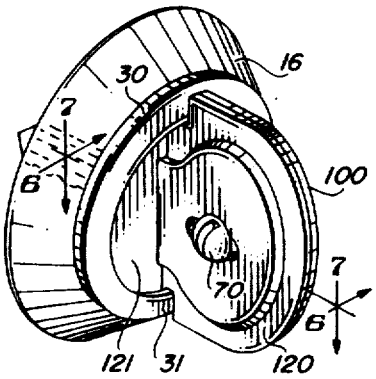
FIG. 5
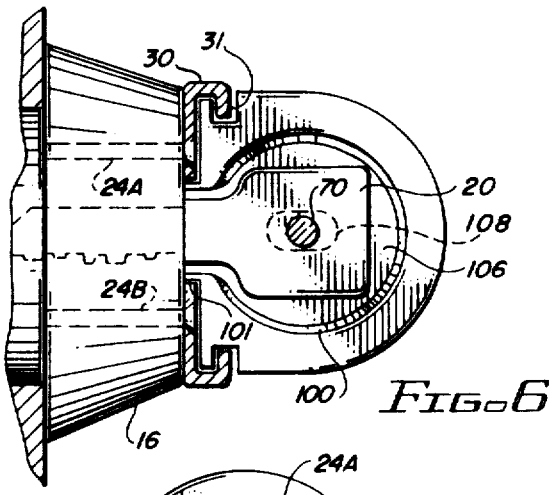
FIG. 6
FIG. 7
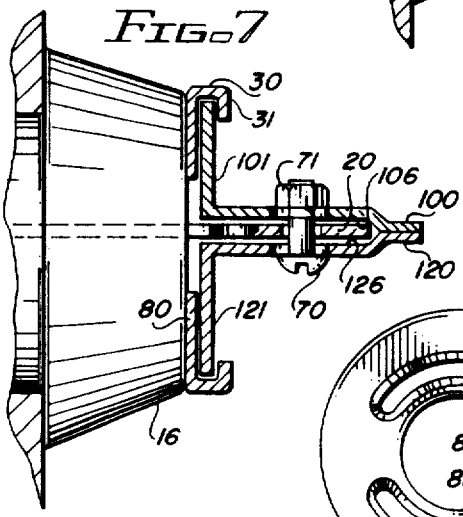
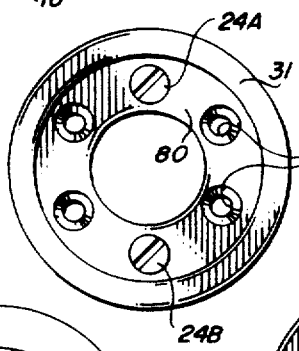
FIG. 9
FIG. 10
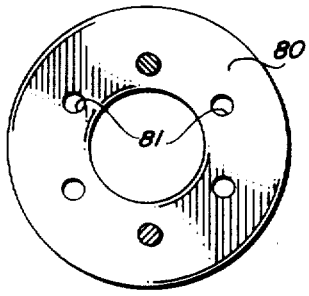
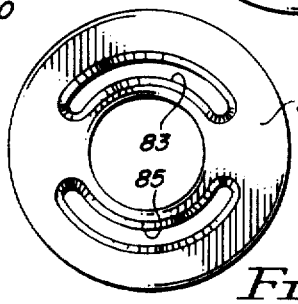
FIG. 11
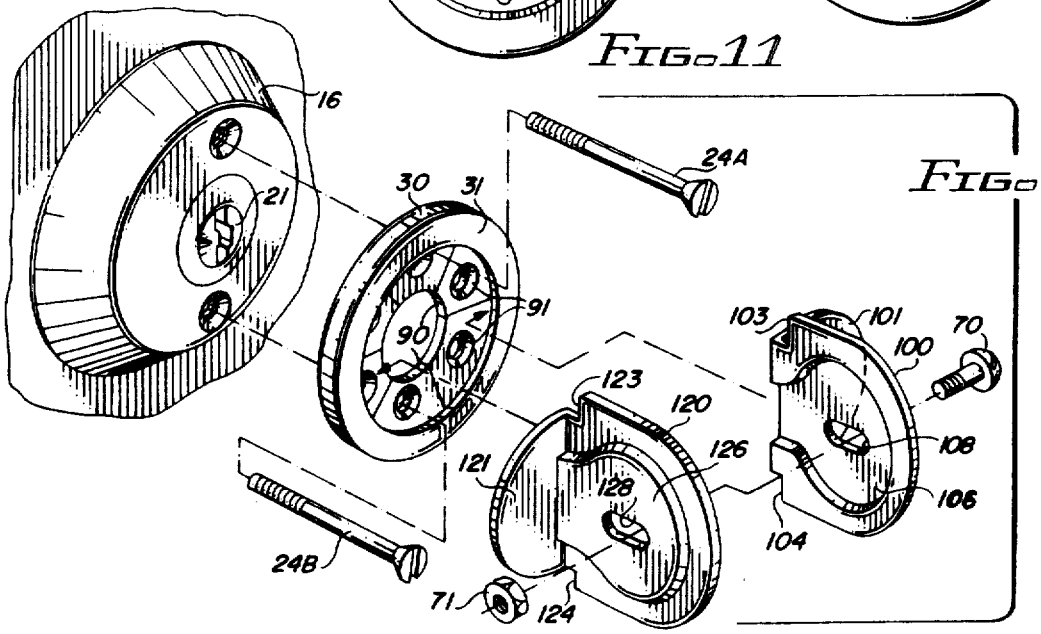
FIG. 8

LOCK CONVERSION MECHANISM

BACKGROUND

To significantly improve the security of homes and business against break-ins by unauthorized persons, double-cylinder lock deadbolts are widely used Insurance companies and police highly recommend the use of such locks as a deterrent to burglaries. The greatest security is obtained from double-cylinder locks, which are key operated from both the inside and outside of the door in which they are placed. When the bolt is engaged (that is, when the door is locked) and both keys are removed, a significant deterrent against break-ins is provided.

When a key in the inner cylinder is used, however, a safety hazard is presented to the occupant of the dwelling if the bolt of the lock is engaged and the key is removed from the cylinder. In the event of a fire, or if for any other reason the occupants need to leave the room or building quickly, the time required in a panic situation to locate a key to release the lock, could result in a disaster.

Consequently, in some areas laws have been enacted which prevent locksmiths from installing double-cylinder key operated deadbolts, because of this fire or panic danger. The inside of a deadbolt lock typically then is provided with a permanently affixed handle to permit its operation While the level of protection against unauthorized use of the door is reduced when a handle permanently affixed to the inner operation of the deadbolt is used, the safety problem is alleviated.

Many dwellings, particularly homes, already exist, which have a key operated cylinder on the inside of a double-cylinder deadbolt. It is expensive to replace such a lock with a non-key operated lock, and many cases it is necessary to replace the entire locking mechanism if the key operated inner cylinder is no longer desired.

Some efforts have been made to retain the inside key in a double-cylinder deadbolt lock, whenever the occupants of the dwelling are located inside the dwelling, to prevent it from being missing in the event of an emergency such as a fire when the persons inside the building desire to leave quickly. This has been accomplished by specially designed lock mechanisms, for example the lock mechanism shown in the Oliver U.S. Pat. No. 4,315,420. That lock mechanism is designed with a mechanical latch in it to engage with a notch on a specially designed inside key, to retain the inside key at all times in the lock unless removal of the key is desired. Such removal is effected by operation of a cam on the key plug on the outside locking cylinder. A problem with the lock mechanism of this patent, however, is that it is a specially designed lock mechanism. It is not a standard double-cylinder deadbolt lock.

Another patent, which uses a non-standard lock mechanism to trap the key on the inside lock, is disclosed in the patent to Allemann U.S. Pat. No. 4,109,496. This mechanism is designed so that whenever the deadbolt is extended to a locked position, the inside key cannot be removed from the lock. Consequently, the lock provides the desired safety features; but, again, a non-standard specially designed double-action lock must be used.

Two older patents, to Helms U.S. Pat.No. 2,441,067 and Kindler U.S. Pat. No. 2,528,757, disclose a rotating arm for captivating old-fashioned keys in the keyhole of a deadbolt lock. This prevents removal of the key. The lever arm extends close to the shaft of the key in the device of Kindler, and blocks the operating end of the key from being withdrawn from the keyhole. This is possible with keys of this type, since they are not modern keys, and the operating part of the key is substantially wider than the shaft. Consequently, a simple swinging lever retains the key.

The device of Helms is directed to the same type of key as used in the device of Kindler, but includes additional apparatus which is clamped to the shaft of the key to provide means for turning the key. These devices would not work with keys of the type currently used for deadbolt locks, since the keys currently used do not have an elongated shank on them, which is necessary for the devices of Kindler and Helms.

It is desirable to provide a lock conversion mechanism to retain the key in the key operated cylinder of a deadbolt lock, which can be used on conventional deadbolt locks without modifying the lock in any way, and which is simple in structure, simple to use, and simple to install.

SUMMARY OF THE INVENTION

It is an object of this invention to provide an improved lock conversion mechanism.

It is another object of this invention to provide an improved mechanism for captivating the key of a key operated cylinder of a deadbolt lock.

It is an additional object of this invention to provide a key-holding member, which is secured to the face of a deadbolt lock cylinder.

It is further object of this invention to provide an improved lock conversion mechanism for the inside cylinder of a deadbolt lock, which is secured to the lock cylinder without requiring modification of the cylinder, and which rotatably secures the key for operation of the deadbolt lock while preventing removal of the key from the mechanism.

In accordance with a preferred embodiment of this invention, a mechanism for retaining the key in the key operated cylinder of a deadbolt lock is provided This is accomplished by means of a base member, which is secured to the face of the key operated cylinder lock assembly, typically by means of the screw or screws which hold the lock assembly together on the door with which it is used. The base member has a circular opening in it, defined by an inwardly turned shoulder, which is spaced from the face of the cylinder lock assembly when the base member is secured to the lock assembly. A key holding member then is rotatably captured between the shoulder of the base member and the face of the cylinder lock assembly to permit insertion and rotation of a key in the key operated cylinder. The key is secured in the key holding member to prevent its removal from the key holding member; so that it is retained in the key operated lock cylinder to which the lock conversion mechanism is attached.

BRIEF DESCRIPTION OF THE DRAWING

FIG. 5 is a perspective view of another embodiment of the invention attached to a deadbolt lock assembly;

FIG. 6 is a cross-sectional view taken along the line 6—6 of FIG. 5;

FIG. 7 is a partial cross-sectional view taken along the line 7—7 of FIG. 5;

FIG. 8 is an exploded view of the embodiment shown in FIGS. 5, 6 and 7;

FIGS. 9 and 10 are details of a variation of the embodiment shown in FIG. 8; and FIG. 11 is a view of another variation of a portion of the embodiment shown in FIGS. 5, 6 and 7.

DETAILED DESCRIPTION

Figure 1:
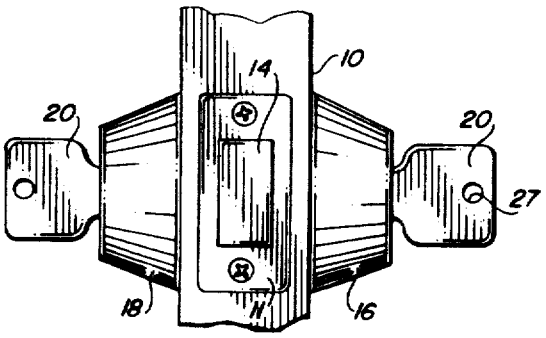
FIG. 1 is a side view of a typical double-cylinder key operated deadbolt lock assembly.

Reference now should be made to the drawings, in which the same reference numbers are used in the different figures to designate the same components. FIG. 1 is an illustration taken from the end of a door 10, showing the installation of a typical double-cylinder key operated deadbolt lock having a deadbolt 14 extending from a plate 11 mounted in the edge of the door. The lock has two operating cylinders 16 and 18 located on the inside and the outside, respectively. A key 20 is inserted into either of the cylinders 16 or 18 to operate the bolt 14 from either side. This is a standard commonly used lock in widespread use today.

Figure 2:
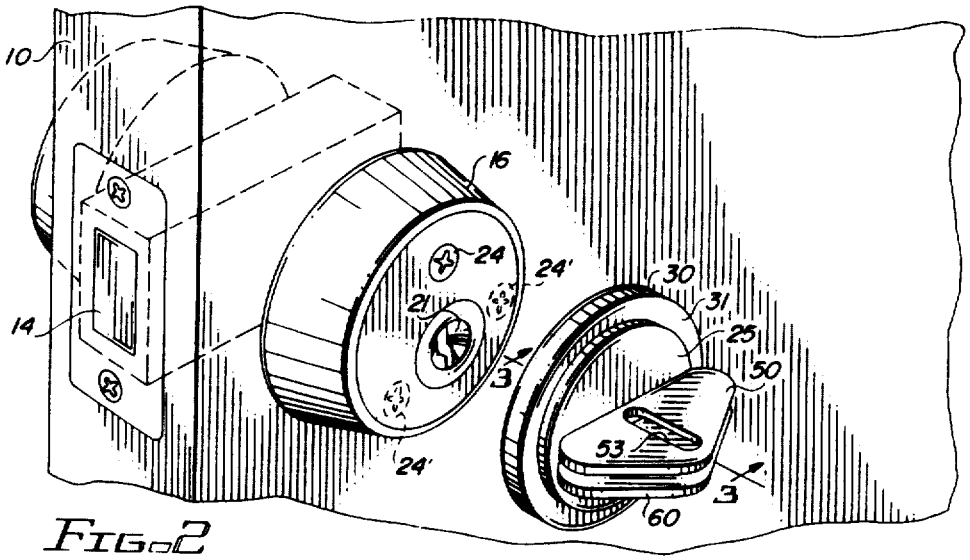
FIG. 2 is a partially-exploded perspective view of the assembly of FIG. 1 showing the manner of installation of a preferred embodiment of the invention.

The lock of FIG. 1 also is shown in FIG. 2, which, additionally, shows the use of an elongated bolt 24 extending through the face of the cylinder 16 on the inside of the lock to secure the two portions of the double-cylinder locks 16 and 18 together with the locking mechanism for operating the bolt 14. The bolt 24 clamps the cylinders 16 and 18 to the opposite surfaces of the door 10 in a conventional manner, and is used to hold the lock mechanism in place on the door 10. The arrangement shown in FIG. 2, using a single bolt 24, is of a standard widely used lock. Many double-cylinder deadbolt locks, however, use two spaced-apart bolts, such as the bolts 24', shown in dotted lines in FIG. 2, to secure the lock together. It should be understood that the ensuing description directed to the specific lock cylinder 16 shown in FIG. 2 also can be applied to a lock cylinder which is secure with two or more bolts 24 of the type illustrated in FIG. 2.

Figure 3:
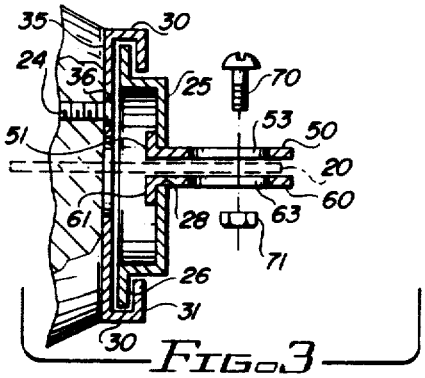
FIG. 3 is a partially exploded cross-sectional view of the preferred embodiment of the invention taken along the line 3—3 of FIG. 2.
Figure 4:
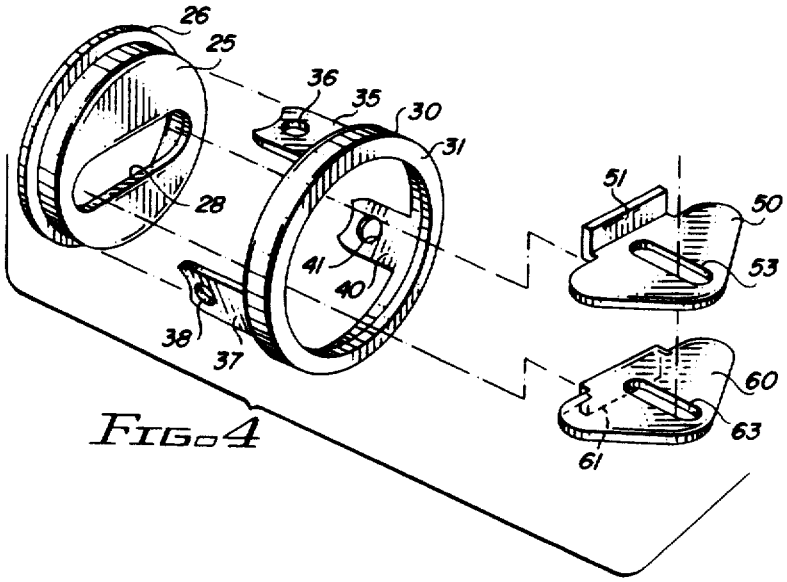
FIG. 4 is an exploded view of the preferred embodiment of the invention shown in FIGS. 2 and 3.

A preferred embodiment of the invention for converting the key operated inner cylinder 16 of the double-cylinder deadbolt lock to one which is similar to a standard lever-operated inner cylinder (in FIGS. 2, 3 and 4). This embodiment includes a base member having an outer ridge 30, and an inwardly turned flange 31, with a circular opening in its center. Inserted into the circular opening is a key holding member 25, with an outwardly turned flange 26 on it spaced downwardly from the face of the member 25. The details of the assembled device shown in FIG. 2 are readily apparent from the cross-sectional view of FIG. 3, and the exploded view of FIG. 4.

The device is assembled, as illustrated in FIG. 4, where the base member 30 has three (or more) legs or tabs 35, 37 and 40 extending from it. Each of the legs has a corresponding hole 36, 38 and 41, respectively, as shown most clearly in FIG. 4. The key holding member 25 is inserted into the circular opening in the center of the flange 31 of the device 30 to the position illustrated in FIGS. 2 and 3. It is especially apparent from FIG. 3 that the flange 26 underlies the shoulder 31 to prevent withdrawal of the member 25 outwardly through the hole in the shoulder 31 of the base member 30. After the key holding member 25 is in place, the legs 35, 37 and 40 are bent inwardly, as shown in FIGS. 2 and 3, to underlie the flange 26 on the device 25.

Once the base member 30 and the key holding member 25 are assembled together, they may be placed on the front face of the inner lock cylinder 16. This is accomplished by removing the bolt 24 to the position shown in FIG. 2, and in FIG. 3. The bolt 24 is inserted through one end of an elongated slot 28 in the face of the key holding member 25. The slot 28 is sufficiently wide to permit the shank of the bolt 24 and the head of the screw to pass fully through it. The length of the slot 28 is chosen to overlie the bolt hole (or holes) in the face of the cylinder 16 when the member 25 is rotated to cause the slot 28 to assume a vertical orientation (not shown in FIGS. 2 and 3). The shank of the bolt 24 then is passed through a hole in one of the inwardly bent legs 35, 37 or 40, such as the hole 36 in the leg 35, and is aligned with the bolt opening in the lock cylinder 16, which is normally used to insert the bolt 24. The bolt 24 then is tightened through the hole 36 in the leg 35 to the point where the head of the screw firmly pulls the leg 35 into tight engagement with the face of the inner cylinder 16 of the deadbolt lock to secure the assembly in place on the face of the lock. In this position, sufficient space is provided between the in-turned legs 35, 37 and 40 of the member 30 and the shoulder 31 to permit free rotational movement of the key holding member 25 in the base member 30, which is held firmly against the face of the inner cylinder of the deadbolt lock by the bolt 24.

The next step is to insert two key retaining plates 50 and 60 into the elongated slot 28 cut in the face of the key holding member 25. These two plates are loosely held in place by tilting them slightly to insert a pair of outwardly facing tabs 51 and 61 through a slot 28 into the position shown in FIGS. 2 and 3. The width of the slot 28 and the length of the tabs 51 and 61, which extend perpendicularly to the faces of the plates 50 and 60, are selected to permit this ready insertion and removal of the two plates 50 and 60 from the slot 28.

The slot 28 is selected to permit alignment of the center of the slot with the keyhole opening 21 in the face of the inner cylinder 16 of the deadbolt lock mechanism. Consequently, a key 20 may be inserted between the plates 50 and 60 to the position shown in dotted lines in FIG. 3. The hole 27 through the end of the key 20 is aligned with a pair of slots 53 and 63 in the plates 50 and 60. A bolt 70 then is passed through the slots 53 and 63 and through the hole 27 in the key 20, and is secured in place by means of a nut 71, as illustrated in FIG. 3. This is done after the key 20 is inserted fully into the keyhole opening 21 in the lock. Consequently, the key, along with the plates 50 and 60 and key holding member 25, may be rotated in a normal manner to engage and disengage the bolt 14 of the lock. Accidental removal of the key 20 from the device, however, will not occur, since it is firmly held in place by means of the bolt 70 and the nut 71. Alternatively, if the permanent attachment of the key 20 to the key retaining member 25 is desired, it may be braised, soldered, or otherwise permanently secured between the plates 50 and 60; so that the key cannot be removed unless the entire mechanism is removed.

It should be noted that the head of the bolt 24 is seated into a chamfered recess in the hole 36; so that it is clear of any interference, either with the shoulder 26 or any other part of the rest of the key retaining member 25 which is held in place by the base member 30.

The plates 50 and 60 also may be made larger to completely cover the end of the key 20. The outer edges of these plates then may be provided with facing ribs to abut one another; so that no gap between the plates is present when they are drawn together by the bolt 70 to hold the key 20.

Reference now should be made to FIGS. 5 through 8, which illustrate another embodiment of the invention. The embodiment shown in FIGS. 5 through 8 is similar to the embodiment shown in FIGS. 2, 3 and 4, with the exception that the functions of the key holding member 25 and the plates 50 and 60 are combined together in a key holding member comprising a pair of plates 100 and 120, thereby effectively eliminating the separate rotatable key holding member 25 of the embodiment of FIGS. 2, 3 and 4. In all other respects, the embodiment of FIGS. 5 through 8 operates in the same manner as the one shown and described above for FIGS. 2, 3 and 4.

FIG. 5 illustrates a fully assembled perspective view of a lock conversion mechanism; and the structure of that mechanism is illustrated in detail in the exploded view of FIG. 8, and the vertical and horizontal cross-sectional views of FIGS. 6 and 7. The base member of the mechanism shown in FIGS. 5 through 8 includes an outer edge 30, and an inwardly turned flange 31 with a circular opening in its center. This is same as the base member used in the embodiments of FIGS. 2 through 4. In place of the three inwardly turned legs or tabs of the embodiment shown in FIG. 4, however, the base member of FIG. 6 has six inwardly turned tabs 90 abutting one another to form a circular opening in the center. This opening obviously is smaller than the circular opening formed by the flange 31. Tapered holes 91 then are formed in each of the tabs 90 to accommodate the shank of a corresponding bolt 24A or 24B, as illustrated, to secure the base member to the face of the cylinder 16 in the same manner described above for the embodiment shown in FIG. 2. The manner in which this attachment is effected is indicated in FIGS. 6 and 8.

In place of .the three parts 25, 50 and 60 described previously, the device shown in FIGS. 5 through 8 includes two key retaining plates 100 and 120, having outwardly turned semicircular legs or tabs 101 and 121, respectively, on them. As is readily apparent from an examination of FIGS. 5, 6 and 8, the plates 100 and 120 each have shoulders (103 and 104 for plate 100; and 123 and 124 for the plate 120) which overlie the outer surface of the flange 31 on the base member. The width of the semicircular tabs 101 and 121, at the point where these two tabs are attached, respectively, to the plates 100 and 120 is less than the diameter of the circular opening formed by the shoulder 31 in the base member. This permits the tabs 101 and 121 to be inserted beneath the shoulder 31, with the plates 100 and 120. The plates then are moved apart, respectively, to place the tabs 101 and 121 beneath the shoulder 31 in the space between the shoulder 31 and the surface of the legs 90.

After the tabs 101 and 121 are inserted into place into the positions shown in FIGS. 5, 6 and 7, the key 20 is inserted between the plates 100 and 120, as shown most clearly in FIGS. 6 and 7. It is to be noted that the plates 100 and 120 have recesses 106 and 126, respectively, formed in them to provide a space for the head of the key 20 while the outer edges of the plates 100 and 120 abut one another to form a closed, attractive appearance to the overall structure, as seen most clearly in FIG. 5. When the key 20 is in place and is fully inserted into the opening 21 of the lock, a bolt 70 is passed through slots 108 and 128 in the plates 100 and 120, respectively, and through the hole in the key. The bolt 70 then is secured tightly in place by means of the nut 71 (FIGS. 7 and 8) to secure the entire assembly together.

The key may be rotated by rotating the composite structure formed by the key 20 and the plates 100 and 120 to lock and unlock the door. The tabs 101 and 120, however, prevent withdrawal of the key from the inner cylinder of the deadbolt lock, producing the same effect as is accomplished by the embodiment described previously in conjunction with FIGS. 2, 3 and 4.

FIGS. 9 and 10 are top and bottom views, respectively, of a variation of the device shown in FIG. 8. Instead of having six adjacent inwardly bent legs 90 to form the surface of the base member for attachment to the face of the lock cylinder 16, a single piece solid-formed ring 80 is used. Tapered holes 81 then are formed, as illustrated, to accommodate the bolts 24A and 24B (or a single bolt, or more than two bolts, as required) to secure the base member to the face of the lock cylinder 16. The operation of the device is the same as the one described above in conjunction with FIG. 8.

FIG. 11 is yet another variation of the attaching portion of the base member, which is similar to the one shown in FIGS. 9 and 10, which has a flange 80A, in which two opposing arcuate slots 83 and 85 are used in place of individually drilled holes 81 of the type shown in FIGS. 9 and 10. The slots 83 and 85 have tapered edges to act as a countersink for the heads of the bolts 24A and 24B; but the operation of the device is the same as described above in conjunction with all of the other embodiments.

Although the structure of the base member 30, which is illustrated, is simple to manufacture and install, the manner of capturing the key holding member 25 in the base member 30 may be effected by other structures or manufacturing techniques, if desired. For example, a rolled edge or shoulder may be formed on the opposite edge of the flange 30 from the shoulder 31 to captivate the flange 26 of the member 25 (or the tabs 101 and 121) in place after it has been inserted to the position shown in FIGS. 2 and 3. It is necessary, however, that whatever structure for the base member 30 is chosen, a provision needs to be made to permit it to be secured to the face of the inner cylinder 16 of the lock. The bolt 24 is a convenient and readily available technique for securing the base member 30 to the face of the lock. The base member 30, however, also could be permanently attached to the face of the lock by means of brazing, welding or suitable adhesives, if so desired. Various changes and modifications will occur to those skilled in the art without departing from the true scope of the invention, which is defined in the appended claims.

The above description of the preferred embodiment is to be considered illustrative of the invention, and not as limiting.

I claim:

1. A mechanism for retaining a key in a key-operated cylinder of a deadbolt lock including in combination:

a base member adapted to be secured to a face of a key-operated cylinder lock assembly, said base member having a circular opening defined by an inwardly-turned shoulder spaced from the face of such cylinder lock assembly when said base member is secured thereto;

a key holding member rotatably captured between said shoulder of said base member and the face of such cylinder lock assembly for permitting insertion and rotation of a key in said key-operated cylinder lock assembly; and means for securing such key in said holding member against removal therefrom.

2. The combination according to Claim 1 wherein attachment bolts secure such cylinder lock assembly to a door and said base member is adapted to be secured to the face of such cylinder lock assembly by means of the same attachment bolts which are used to secure such cylinder lock assembly to the door.

3. The combination according to Claim 2 wherein said key holding means includes a plate extending outwardly from said key-holding member, and aligned with a key inserted into such cylindrical lock assembly, with said plate being secured to such key.

4. The combination according to Claim 3 wherein said base member has flange means adapted to be secured to the face of such cylinder lock assembly, said flange means spaced a sufficient distance from said inwardly-turned shoulder to permit rotation of said key-holding member in a space between said flange means and said shoulder of said base member.

5. The combination according to Claim 4 wherein said key-holding member comprises a circular portion extending through the circular opening defined by said inwardly-turned shoulder on said base member, and further including an outwardly-turned flange located in a space between said shoulder on said base member and the face of such cylinder lock assembly to permit rotation of said key-holding member relative to said base member.

6. The combination according to Claim 1 wherein said key-holding means includes a plate extending outwardly from said key-holding member, and aligned with a key inserted into such cylindrical lock assembly, with said plate being secured to such key.

7. The combination according to Claim 6 wherein said base member has flange means adapted to be secured to the face of such cylinder lock assembly, said flange means spaced a sufficient distance from said inwardly-turned shoulder to permit rotation of said key-holding member in a space between said flange means and said shoulder of said base member.

8. The combination according to Claim 7 wherein said key-holding member comprises a circular portion extending through the circular opening defined by said inwardly-turned shoulder on said base member, and further including an outwardly-turned flange located in a space between said shoulder on said base member and the face of such cylinder lock assembly to permit rotation of said key-holding member relative to said base member.

9. The combination according to Claim 1 wherein said base member has flange means adapted to be secured to the face of such cylinder lock assembly, said flange means spaced a sufficient distance from said inwardly-turned shoulder to permit rotation of said key-holding member in a space between said flange means and said shoulder of said base member.

10. The combination according to Claim 9 wherein said key-holding member comprises a circular portion extending through the circular opening defined by said inwardly-turned shoulder on said base member, and further including an outwardly-turned flange located in a space between said shoulder on said base member and the face of such cylinder lock assembly to permit rotation of said key-holding member relative to said base member.

* * * * *